United States Patent [19]

Weber

[11] 4,431,302

[45] Feb. 14, 1984

[54] CHARGE LEVEL CONTROL FOR AN ELECTROCHARGEABLE MEDIUM

[75] Inventor: Harold J. Weber, Sherborn, Mass.

[73] Assignee: Coulter Systems Corporation, Bedford, Mass.

[21] Appl. No.: 352,595

[22] Filed: Feb. 26, 1982

[51] Int. Cl.[3] ..... G03G 15/00

[52] U.S. Cl. ..... 355/14 CH; 355/77; 250/325; 430/35

[58] Field of Search ..... 355/14 CH, 3 CH, 77; 250/325; 361/225; 430/35, 55

[56] References Cited

U.S. PATENT DOCUMENTS

| | | | |
|---|---|---|---|
| 3,564,239 | 2/1971 | Kushima | 355/3 CH |
| 3,649,114 | 3/1972 | Vlach et al. | 355/14 CH |
| 3,787,706 | 1/1974 | De Geest | 361/221 X |
| 3,944,354 | 3/1976 | Benwood et al. | 355/3 R |

*Primary Examiner*—Richard L. Moses

[57] ABSTRACT

Apparatus is described for providing controlled corona charging of an electrophotographic member that moves past a corona charging electrode. A corona sensor probe near the charging electrode receives a sample of the corona current flow from the electrode that is proportional to the current flow as it may be modified by extraneous influence, including air pressure, humidity, and corona electrode potential. The probe produces a signal that is adapted to vary the movement rate of the member past the charging electrode, being faster for a sensed increase of corona current and slower for a sensed decrease of corona current. The effective result is an electric charge on the electrophotographic member surface that is uniformly about constant, independent of the variations wrought by most external influences.

37 Claims, 11 Drawing Figures

Figure 1:
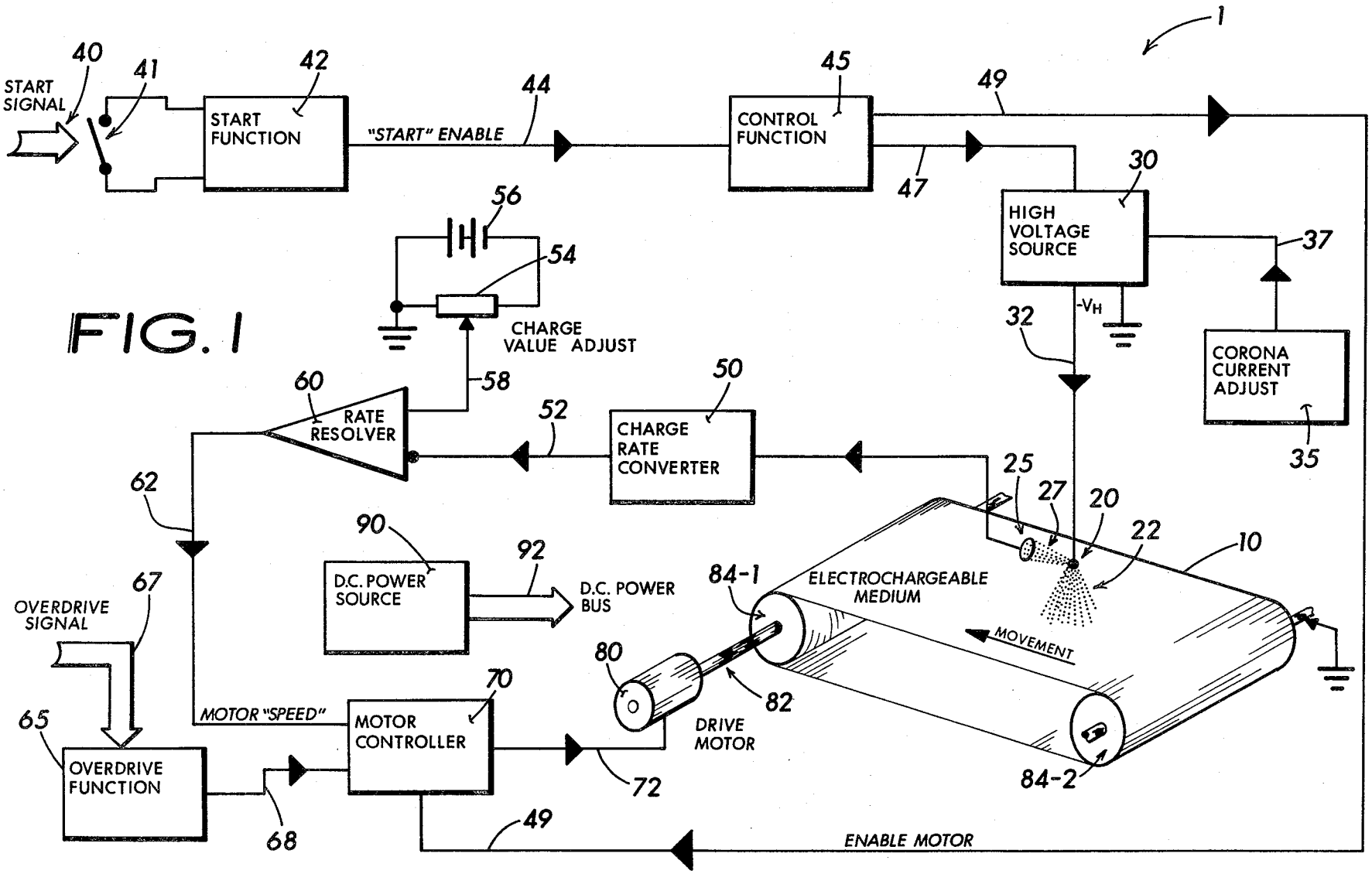

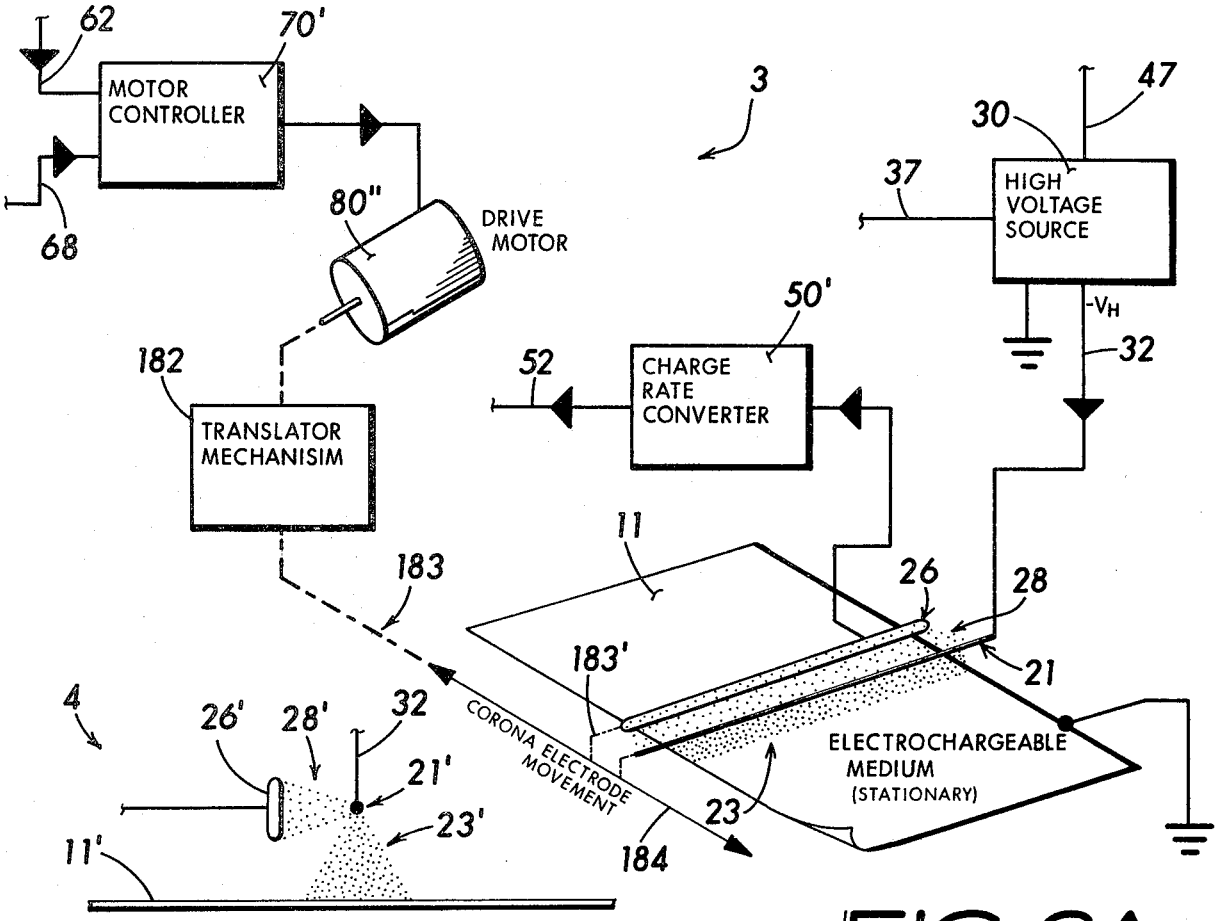
FIG. 6B
FIG. 6A
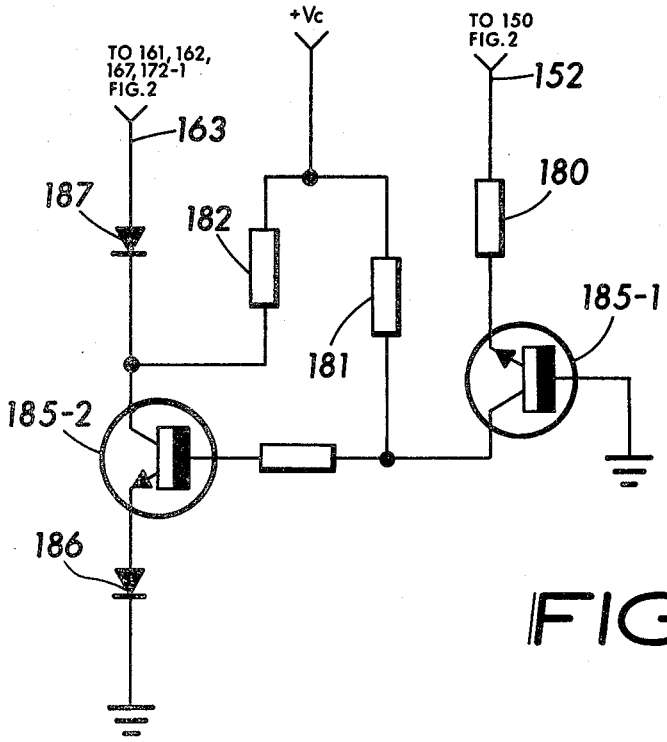
FIG. 7

CHARGE LEVEL CONTROL FOR AN ELECTROCHARGEABLE MEDIUM

BACKGROUND OF THE INVENTION

In the field of electrophotography it is a well known art to employ a corona producing electrode in proximate relationship with a chargeable electrophotographic material. For example, when an electrochargeable surface is prepared on a face of a foil-like substrate, the usual practice is to induce a corona discharge between the electrode and the substrate surface by arranging the corona electrode with an electrode-to-surface spacing around one centimeter. A high direct current voltage level between three and perhaps nine kilovolts is applied between the electrode and the surface, usually with the corona electrode connected to the most negative terminal. Thereby a corona discharge is established, as it is commonly expressed, between the corona electrode and the surface. The noticeable effect is the ionization of the atmosphere, usually air, with the attendant ozone production and slight trace of purplish-blue light glow.

The prior art teaches methods to stabilize this discharge for better control of the substrate charge values. In particular, the instant inventor, as well as others, have employed the constant current regulation of the corona electrical discharge value, adjustment of voltage potential, and other such means which serve to act upon the corona so as to compensate for changes in the corona value.

The practicing artisan's search for improvement over known methods will be immediately arrested by the novelty offered by this invention. The modulation of the charge laid down on the electrophotographic surface is accomplished by way of altering the speed or rate by which the chargeable surface is caused to traverse past the corona field. This is to say: if the corona field is weak, the translational relationship between the two elements will be slow, whilst should the corona field increase then in a like way the translational rate will increase. The result is the effective energy per unit area on the electrochargeable surface will remain about the same irrespective of the absolute corona current value.

The practice of this invention includes a novel corona-responsive probe located adjacent to the corona electrode and effective therewith so as to receive some small ancillary sample of the true corona current without negating the uniformity of the main corona charge reaching the electrochargeable surface. This sampled current then serves to guide a control loop which operates so as to increase the effective speed of a drive motor in proportion to any increase in corona current, or vice-versa.

The merit in this new approach becomes apparent when the artisan considers that parameters which are for the most part uncontrollable tend to strongly influence the true corona current or charging field reaching out from the corona electrode to the electrochargeable surface. In particular, atmospheric pressure and humidity have a strong effect on the corona field. The earlier art methods of constant current control or voltage adjustment ofttimes elude the attainment of good compensation for these corona affecting influences, thereby comforting an operator into the belief that the end result: that of achieving a finite unit area charge on the substrate is being accomplished when, in reality, it is not, due to sneak current paths which rob much corona current in common cost-effective physical arrangements used for supporting the corona electrode structure. Such paths serve to shunt the corona current and the nature of such parasitic current paths is that they are usually non-linear with corona potential and time, i.e. dirt, for example, on insulators or the like varies in amount and composition with time.

SUMMARY OF THE INVENTION

The gist of my invention is to provide a control means that varies the movement of an electrochargeable medium, such as a photoconductor supported on a substrate, relative to a corona charging electrode. The invention operates by sensing a sample of the corona current, either impinging directly or indirectly on the medium, and utilizing that current sample to compute a drive signal for an electric motor that serves to translate the electrochargeable medium relative with the corona electrode. This translation may occur either by moving the medium relative to the electrode, or conversely by moving the electrode to the medium. In either case, the rate of movement is variably controlled so that the average current density per unit area on the electrochargeable medium surface remains substantially constant irrespective of the instantaneous corona current. Such constancy is achieved by increasing the movement rate whenever the corona current increases and conversely decreasing the rate whenever the corona current decreases.

The invention teaches the use of an ancillary probe that mounts near the corona electrode and forms a parasitic current path between the corona electrode and the probe that samples the absolute, instantaneous corona field produced by the electrode. By way of the probe a true sample of the corona field current density is measureable, a measurement that is independent from the effects of atmospheric pressure, humidity, etc. The probe signal is adapted through a converter to energize the windings of a drive motor to vary the relative movement rate of the electrochargeable medium relative with the corona source.

The invention furthermore shows a method whereby the current return path between the electrochargeable medium and the ground return circuit of the corona producing high voltage source is measured, usually by way of a sampling resistor, and the signal so produced is employed to adjust the speed of a drive motor to keep the unit area/time charge conditions constant. None of the advantages afforded by the instant invention is the ability to preset the corona current (corona field intensity) at a relatively constant value which is optimum for a given electrode configuration. Such a condition of optimizing the absolute current density on the electrode can lead to a much more uniform corona field without the "beading" so commonplace with ordinary linear wire type coronas. Therefore, once the optimum corona current for a given electrode structure is established, that current need not be altered and only the transport speed of the electrochargeable medium relative with the corona electrode is changed. The net effect is substantially the same as varying the corona current itself, insofar as the energy received by the electrochargeable medium surface is concerned.

In particular, the invention relates the charging of photoconductors used in electrophotography. When used with photoconductors having a relatively wide dynamic range, i.e., a broad "gray scale," the importance of uniform field charging becomes of paramount significance, and it is in the charging of this type of photoconductor that the true advantages afforded by the instant invention come into play.

It is therefore an object of this invention to teach a means for providing a uniform average current density on the surface of an electrochargeable medium from a corona electrode source having fixed operating conditions wherein the average current impinging upon the electrochargeable medium may be spoiled by the effects of atmospheric pressure, humidity, and other environmental or structure influences.

DESCRIPTION

A functional diagram for the charge level control is generally shown 1 in FIG. 1. A corona electrode 20, such as a point source or microsphere, operates as a source for a main corona discharge 22 to the acceptor surface of an electrochargeable medium 10. In addition to the main corona discharge 22, an ancillary corona discharge 27 also flows between the corona electrode 20 and a probe 25. The effect of this ancillary discharge current 27 which flows to the probe 25 is to provide a charge rate signal value 52 at the output of the charge rate converter 50 which is proportional to the ancillary corona magnitude. The value in this lies in the fact that the ancillary corona current 27 is directly proportional to the main corona discharge 22. What this means is that any particular condition which effects a change in the main corona discharge will be measured as a value change by the probe 25. Such changes are common and are brought about by a variety of parameter changes, either alone or in combination, such as: corona electrode voltage; atmospheric pressure; humidity; corona electrode deterioration; and the like.

The resulting charge rate signal 52 couples to one input of a rate resolver 60, which in elementary form, functions as a differential amplifier in which event the charge rate signal 52 couples to the INVERTING input, while a positive d.c. value 56 couples, by way of an adjustment 54, to the NON-INVERTING input 58. The effect is a summing of the rate signal 52 with the d.c. value produced by the charge value adjustment 54, where the latter adjustment serves to set the absolute charge rate signal produced at the output 62 of the rate resolver.

A motor controller function 70 provides a motor excitation signal 72 to the drive motor 80. This excitation signal is, in the main, determined by the value of the absolute charge rate signal. The excitation signal causes the drive motor 80 to move the electrochargeable medium, such as a foil or film, over a drive roll 84-1 and idler roll 84-2, the effect being the translation of the medium 10 past the field 22 produced by the source 20 at a rate which is proportional to the corona discharge current received by the probe 25 which is, as said before, proportionate to the main discharge 22. The sense of the combination is such that, as the ancillary corona discharge 27 increases, the drive motor will run faster thereby exposing the medium 10 to the main discharge 22 for less total time.

An overdrive function 65 accepts an overdrive singal 67 and produces a signal 68 which couples to the motor controller 70 so as to override the absolute charge rate signal value effects.

The operation of the motor controller 70 is further controlled, in the sense of being enabled or inhibited, by a motor control signal 49 produced by the control function 45. The control function is for the most part a combination of control elements which in part receive the start function signal 44 produced by the start function 42 element, as for example when a START SIGNAL depicted by arrow 40 actuates a switch 41 or the like.

The control function 45 also produces a corona control signal 47 which serves to enable the high voltage source 30 upon command. The source usually couples 37 with a corona current adjust 35 element that determines the high voltage values coupled by the source 30 to the corona electrode 20.

Figure 2:
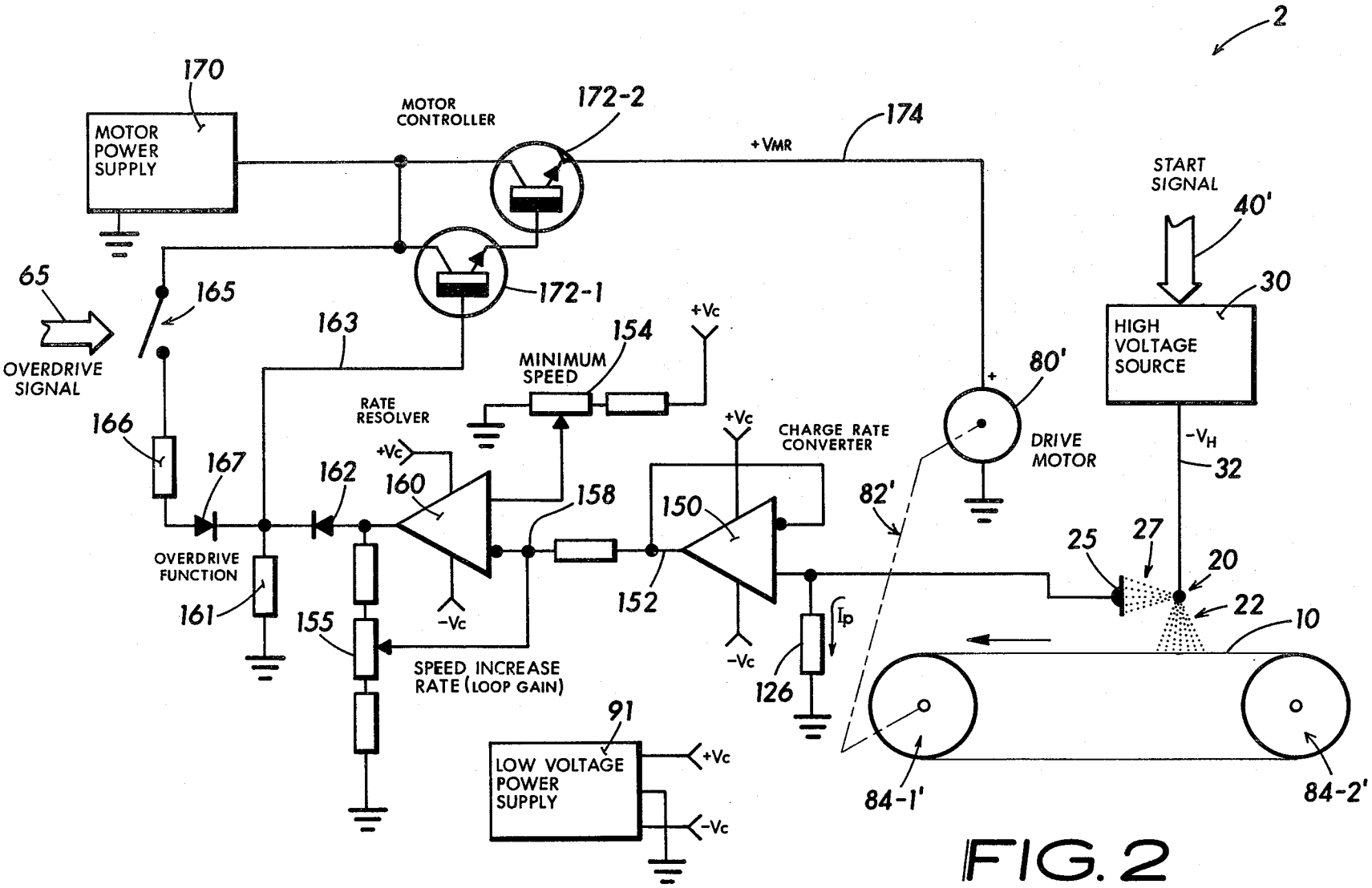

A more explicit hookup for the invention is shown in FIG. 2 wherein the important element functions are expanded upon, thereby providing for a better understanding of operation by a skilled artisan.

The start signal 40' enables the high voltage source 30 which produces a high, usually negative, corona voltage $-V_H$ coupled to corona electrode 22. The result is at least twofold:

(1) a main corona discharge 22 occurs between the corona electrode 20 and the electrochargeable medium 10 surface; and, (2) an ancillary discharge 27 occurs between the electrode 20 and the probe 25.

A useful charging action is produced on the medium 10 surface by the discharge 22, whilst the discharge 27 causes a flow of current $1_p$ through resistor 126 as coupled 125 to the probe and to ground. This probe current $I_p$ produces a small voltage $E_p$ equal to:

$$-E_p = -I_p \cdot R_{126}$$

at the NON-INVERTING input of the operational amplifier 150 operative as a voltage follower or, more importantly, an impedance transformer for coupling the relatively high effective probe circuit impedance to subsequent lower impedance circuit without introduction of an error produced by loading. The voltage developed across resistor 126 by the probe current may typically be on the order of 3 volts, with a resistor 126 value of 510 kilohms and a probe current around 6 microamperes. The resultant negative output signal 152 couples to the INVERTING input 158 of a differential amplifier 160, where the value is SUMMED with a positive value introduced on the NON-INVERTING input by the MINIMUM SPEED potentiometer 154 as coupled with source $+V_c$. The operational amplifier satisfies the rate resolver function by the expedient of providing an output signal which is POSITIVE in sign and INCREASES in proportion to any increase of probe current $I_p$ through resistor 126. This positive output value couples through a steering diode 162 and shunt resistor 161 into the effective base circuit 163 of a darlington connected transistor emitter follower pair 172-1, 172-2.

The motor power supply 170 produces a positive output which couples to the collector of the transistors 172-1, 172-2 and therefrom 174 in some proportion to the drive motor 80'. The effective motor excitation signal value $+V_{MR}$ is modulated to be a value that is about that appearing on the output of the operational amplifier 160. More precisely, in the shown circuit, the value $+V_{MR}$ is about 2.1 volts less positive than the amplifier output value due to the effective voltage drops across the diode 162, and the transistor 172-1, 172-2 base to emitter junctions.

What ensues, of course, is that the motor 80' drives the medium 10 past the corona electrode at a rate which is in proportion to the corona current. The rate of movement increases when the corona current increases. In the preferred embodiment as described, doubling the current will typically double the rate. Such action does require a drive motor which is substantially linear in speed with applied voltage over the operating range. Therefore, while the embodiment in the figure does not depict such detail, it is entirely within the scope of the inventor's anticipation that auxiliary circuits are used to effect such tracking linearization without defeating the scope of the invention's instruction. Such means, as servo loops, tachometer feedback controls, or the like, are well known in the art and can be considered as a usual part of a good motor controller such as element 70 in FIG. 1.

Figure 3:
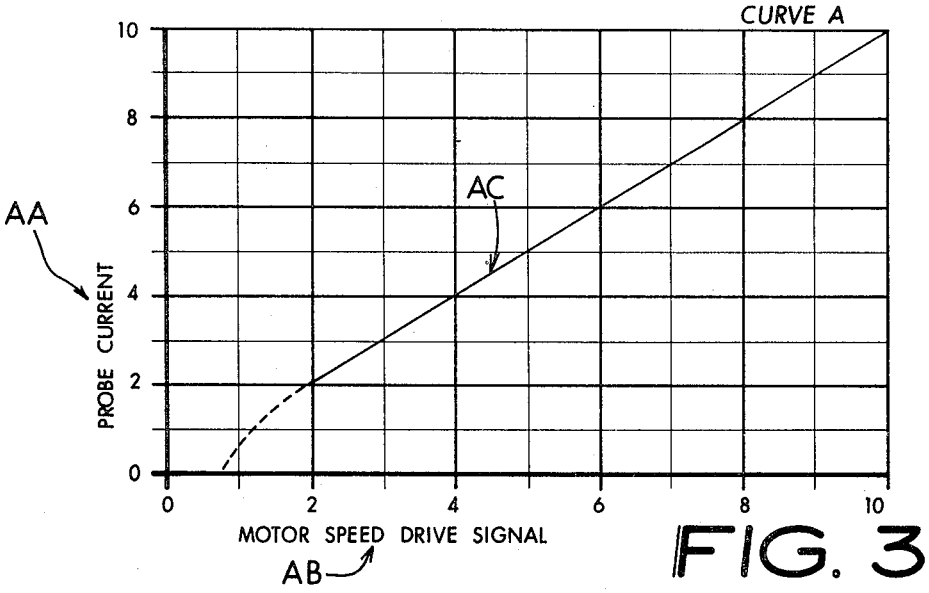

The curve AC of FIG. 3 depicts how the relative motor speed drive signal AB is varied over most of the range AC in substantially linear proportion compared to the changes in the relative probe current AA. The low level non-linearity, between zero and two, is brought about by the intrinsic corona source instability when operating at a level which represents but a small percent of the maximum design range.

Figure 4:
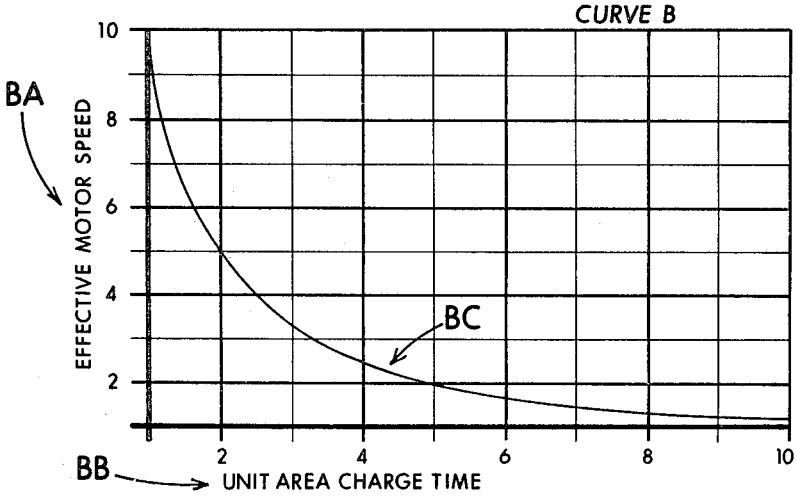

The curve BC of FIG. 4 illustrates how the relative effective motor speed BA, which is translated into electrochargeagle medium movement, produces a corresponding proportionate change in the effective unit area charge time BB on the medium surface. The change is brought about by the effect of different absolute charging times produced by changes in corona to medium translation.

Figure 5:
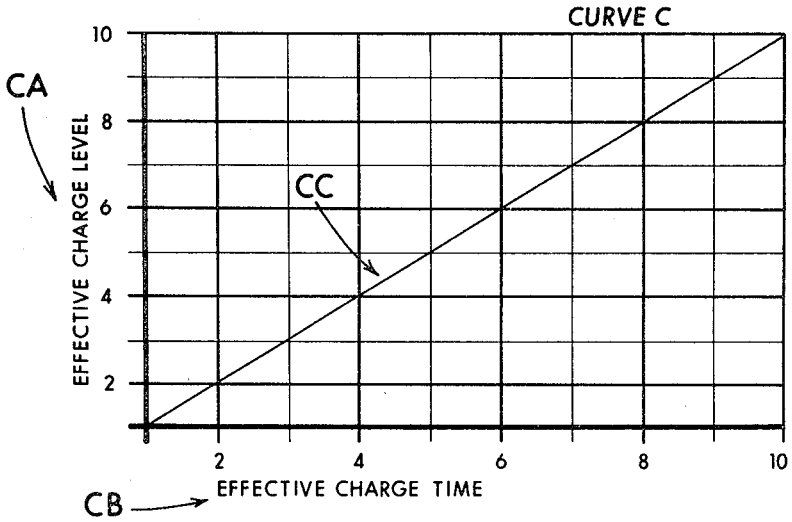

The curve CC of FIG. 5 is a representation showing how the relative corona current CA reaching the medium surface relates to the effective charge time CB which results in a relatively uniform resultant charge value on the medium surface irrespective of charge current.

While the aforesaid invention modes describe a moving electrochargeable medium, the same effect taught as the essence of the invention is brought about by moving the corona electrode and the probe relative to the medium while holding the medium stationary. What is important is the absolute rate of movement between the corona source and the medium, not how it is brought about. Such an arrangement is depicted in FIG. 6A.

The motor controller 70' is shown connected as described for aforesaid FIG. 1, with the output coupled to the drive motor 80''. The motor operates a translator mechanism 182 which is effectively coupled 183, 183' to the supportive means for the corona electrode 21 and probe 26. Intrinsic in this arrangement is the ability to have the drive motor produce a scanning, or sweep, of the corona electrode along one axis of the electrochargeable medium as shown by the arrow 184 entitled CORONA ELECTRODE MOVEMENT while maintaining a constant probe to corona electrode spacing, and a constant corona electrode to electrochargeable medium spacing. As before, the probe 26 current is accepted by the charge rate converter 50' so as to produce a signal 52 which couples to the rate resolver 60 and other circuit functions taught in FIG. 1.

Some detail of the corona electrode functions is shown in accord with FIG. 6B. The view is such that the artist is looking down the length of the corona electrode 21', which might be a fine wire about 0.0025 inch in diameter. In a like way the probe 26' is viewed along its length. What is clearly shown is the division of some corona discharge 23' and attendant current flow to the electrochargeable medium 11, while yet some other part of the current flow is by the ancillary corona discharge 28' to the probe 26'.

With constant mechanical arrangement, e.g., spacing, between the three effective electrodes 21, 11, 26 it has been shown that any factor which affects the main corona 23' will proportionately affect the ancillary corona 28'.

FIG. 7 teaches a clamp circuit which serves to STOP the drive motor excitation in the event that no corona current is flowing. This prevents the corona electrode from being moved relative to the electrochargeable medium at a "MINIMUM SPEED" rate and thereby precludes "false charging." The shown circuit operates as an adjunct to that of FIG. 2. The output 152 of the rate converter buffer 150 connects through a resistor 180 to the emitter of the NPN transistor 185-1 which operates as a common base amplifier. In the absence of a corona discharge, 22, no probe 25 current flows, the result of which is a near zero value on the buffer output 152. Under this condition, resistor 181 pulls the transistor 185-1 collector towards the positive value $+V_c$. This further effects current flow into the base of transistor 185-2 that overcomes the combined effects of the base to emitter drop and the drop across diode 186. The result is the output of the rate resolver amplifier 160 is clamped to within about 2 volts of ground resulting in less than 1.5 volts on the juncture 163 coupled to transistor 172-1 base and therefore about 0 volts on the $+V_{MR}$ line 174, resulting in the effective stall of the drive motor 80'.

When a corona discharge 22, 27 does occur, the resulting probe 25 current $I_p$ produces a NEGATIVE voltage on the output line of the buffer 150. This negative value couples through resistor 180 to the emitter of the transistor 185-1, resulting in the effective turn-on of the NPN device. The result is that part of the positive value $+V_c$ which might appear on the transistor 185-1 collector through resistor 181 is reduced to a near zero value due to intrinsic current flow in device 185-1 in induced by the forward biased state of the base to the emitter junction. This resulting near zero value provides less than sufficient current flow through resistor 225 into the base of transistor 185-2 to overcome the two attendant junction drops, with the result that the transistor 185-2 collector is drawn to a value near $+V_c$ by the resistor 182. This results in reverse biasing of diode 187, thereby precluding any further effects by the clamp circuit on the function values established by the rate resolver 160 output.

Figure 8:
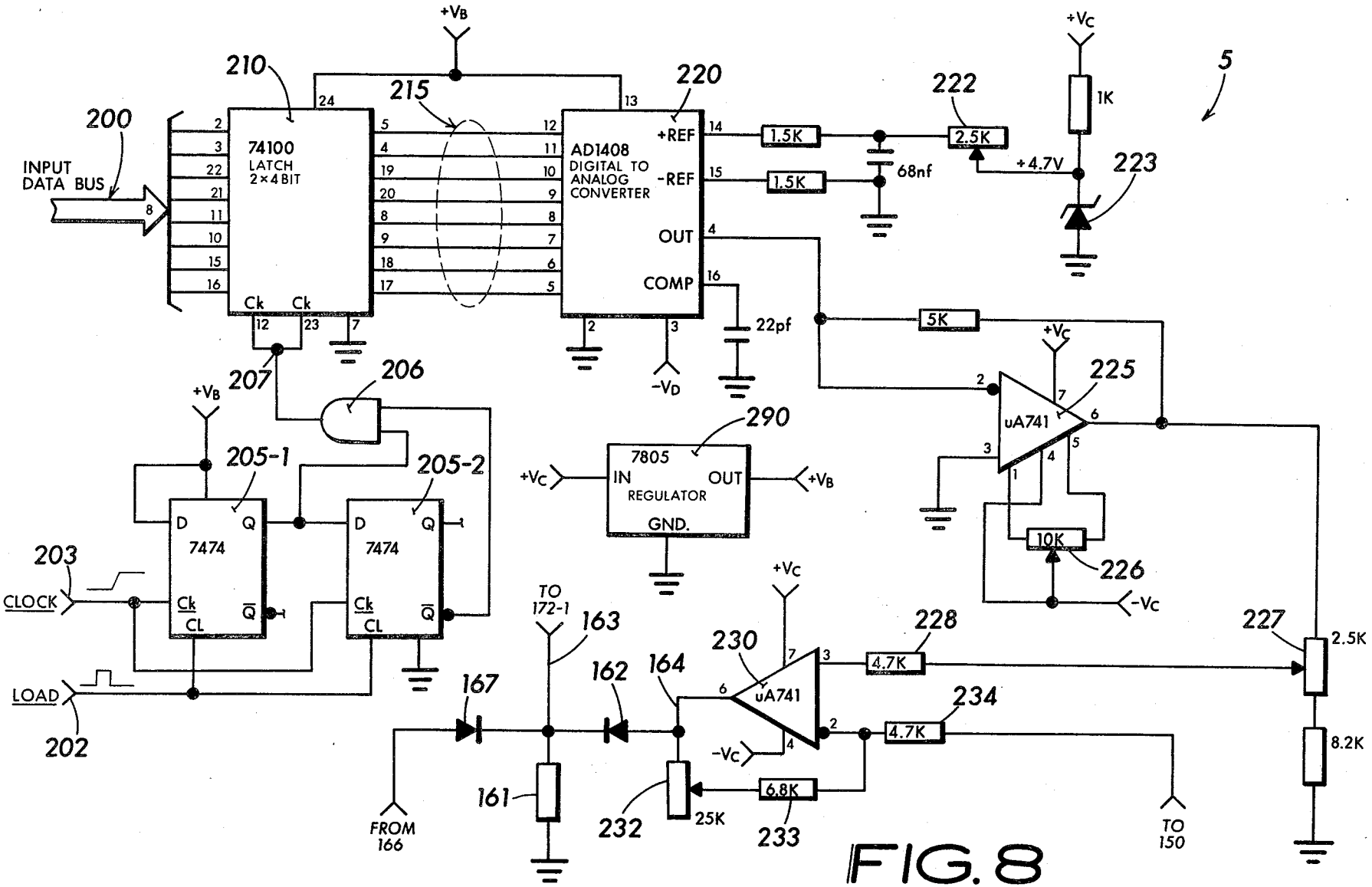

The coupling of the control circuit elements, as depicted in FIG. 2 with the circuits as in FIG. 8 results in a unique combination which provides control parameters under the control of an externally supplied data bus signal.

The data bus signal 200, as might be provided from a separate computer function, is entered into the latch 210 as any combination of, say, eight binary levels. Actual entry into the storage elements of the latch occurs when a LOAD signal 202 logic 1 occurs, enabling the pulse synchronizer consisting of D-type flip-flops 205-1, 205-2 to produce one brief pulse at the output on AND gate 206 which is but one CLOCK input 203 cycle in duration. The AND gate 206 couples to the CLOCK (CK) inputs 207 on the latch 210. This results in the input data being transferred to the output 215 whenever a logic 1 appears on the LOAD line.

Quite equivalent operation for latch loading can be had by using an edge-triggered type of latch instead of the exampled 74100 and such would be well within the abilities of a skilled artisan. The latched data lines 215 serve to input to an AD1408 digital-to-analog converter 220 manufactured by Analog Devices, Inc., Norwood, Mass. The analog signal produced from the operational amplifier 225 is derived from the binary states on the converter 220 input and serves therefrom to input the rate resolver function 230 NON-INVERTING input through resistor 228 and level setting potentiometer 227. The loop gain for the resolver is set by the feedback rheostat 232 and resistor 233 as ratioed against resistor 234 connected between the inverting input and the output 164 of amplifier 230. A monolythic regulator 290 reduces the higher $+V_C$ level, usually +15 volts to the lower $+V_B$ level, usually +5 volts.

Figure 9:
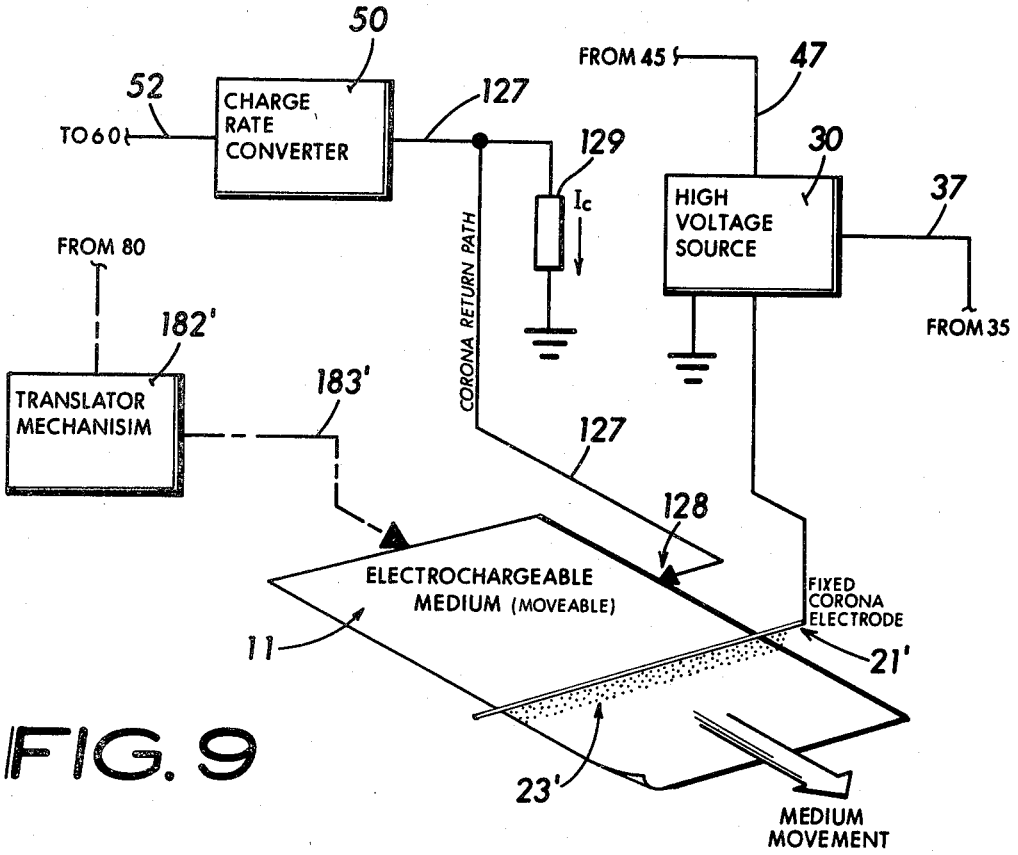
Figure 10:
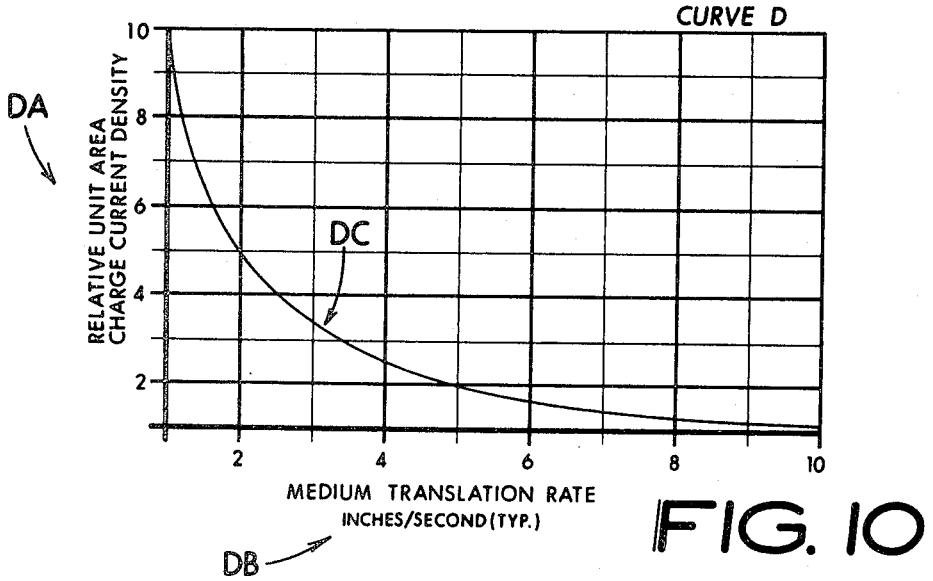

An alternative embodiment that embraces the essence of my invention appears in FIG. 9. It shall be remembered that the underlying objective of the invention is to vary the relative movement rate of the electrochargeable medium relative to the corona source in proportion to the corona current impinging upon the medium surface. In the teaching of FIG. 9, the electrochargeable medium to A is translated by a mechanism 46 to move beneath a corona wire source 1A. The ground return 22 for the electrochargeable medium passes through a resistor 23, thereby the current flow $I_c$ produced through the resistor by the action of the corona path develops a voltage at the input of the charge rate converter 20 that is substantially negative in value and increases with increasing corona current. Therefore, the charge rate converter produces an output 21 that, by way of the circuitry illustrated in FIG. 2, acts to increase the speed of motor 45. The effect is a substantially constant unit area/time relationship of charge energy impinging the electrochargeable medium by way of the corona. It will be obvious to the artisan that the connections of FIG. 9 are quite equivalent to the connections of FIG. 6A, where one considers the fact that the electrochargeable medium 2A acts equivalent to the probe 26 of FIG. 6A, producing a current flow $I_c$ through resistor 23. It is therefore the purpose of my invention to show apparatus which will vary the rate of movement of an electrochargeable medium relative to a source of corona in proportion to the instantaneous corona discharge current.

It is yet another purpose of my invention to teach the use of an ancillary pickup probe to sample a small percentage of the main corona emitted by a corona electrode proximate with an electrochargeable medium and thereby compute a signal which serves to vary a drive motor speed in proportion to the corona current, effecting variable movement of the electrochargeable medium relative to the corona electrode, thereby maintaining constant unit area/time charge energy.

Another object of the invention is to show means whereby the return path current between the electrochargeable medium and what is effectively the ground return of the corona producing high voltage source is sampled and the signal developed by this sample is employed to vary the speed of a translator mechanism that moves the electrochargeable medium relative with the corona source.

It is apparent that there has been provided in accordance with this invention a responsive, dynamically-controlled corona charging means for use in electrophotographic apparatus that fully satisfies the objects, means, and advantages set forth hereinbefore. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the attendant claims.

What I claim is:

1. Charge control method for producing substantially constant charge accumulation in the effective charge supporting mechanism of an electrochargeable medium, as provided by:

(a) exposing said medium to a corona charging field;

(b) measuring at least a portion of said field's effective intensity;

(c) moving said medium relative with said field at various instant rates which are proportional to the measured value of said effective intensity.

2. Method of claim 1 wherein said proportional rates are increased when the measured said intensity increases.

3. Method of claim 1 wherein said measuring is obtained by receiving a sample of a portion of the corona charging field and therefrom establishing the magnitude of the measured value.

4. Method of claim 1 wherein said measuring is obtained by receiving a sample of the current flow effectively occurrent in the electrical path between the electrochargeable medium and the corona charging field and therefrom establishing the magnitude of the measured value.

5. Charge control apparatus for producing a substantially constant charge accumulation in the effective charge supporting mechanism of an electrochargeable medium comprising therefor:

(a) source means for producing corona discharge;

(b) electrochargeable medium means oriented in juxtaposition with said source means, effective for accepting substantial portion of said corona discharge;

(c) translator means effective to produce about parallel relative movement between said medium means and said source means; and (d) control means including first input means coupled with a portion of said corona discharge, and output means coupled with said translator means, effective to convert any change in corona discharge level into a corresponding change in the rate of said relative movement.

6. Apparatus of claim 5 wherein said translator means produces movement of the said source means uniformly adjacent with the working surface of a relatively stationary medium means.

7. Apparatus of claim 5 wherein said translator means produces movement of the working surface of the said medium means uniformly adjacent with the said source means.

8. Apparatus of claim 5 wherein said first input means comprises probe means effective to receive a sample of said corona discharge.

9. Apparatus of claim 8 wherein said probe means is provided as an ancillary electrode means adjacent with said source means, effective for receiving a representative portion of the total corona discharge current flow.

10. Apparatus of claim 5 wherein said first input means comprises a current sensor means coupled between the medium means and the electric return path to the source means, whereby said sensor means produces a signal proportional to said corona discharge level.

11. Apparatus of claim 10 wherein said sensor means comprises a resistor in the range of 100 ohms to 100,000 ohms, wherein further the produced said signal is in the range of 100 millivolts to 100 volts, representing a corona discharge current in the range of 50 microamperes to 10 milliamperes.

12. Apparatus of claim 5 wherein said translator means rate of relative movement increases relative with an increase in the corona discharge level.

13. Apparatus of claim 7 wherein said medium means comprises an endless loop, e.g. a belt, of electrochargeable material.

14. Apparatus of claim 5 wherein said electrochargeable medium means comprises a light sensitive electrophotographic means.

15. Apparatus of claim 5 wherein said source means comprises a thin elongated wire member suspended adjacently parallel with the effectively planar surface of said medium means.

16. Charge control apparatus effective for maintaining a substantially constant electric corona discharge field intensity and providing various levels of charge accumulation in the effective charge supporting mechanism of an electrochargeable medium, comprising therefor:

(a) source means of substantially constant corona discharge level;

(b) electrochargeable medium means oriented in juxtaposition with said source means, effective for accepting a substantially constant portion of said corona discharge;

(c) translator means effective to produce about parallel relative movement between said medium means and said source means; and, (d) control means including first input signal means coupled with a portion of said corona discharge, second input signal means presettable to a desired value of charge accumulation, and output means coupled with said translator means, effective to variegate the rate of said relative movement in response to changes in the presettable desired value.

17. Apparatus of claim 16 wherein said control means further combines any variation in said first input signal with preset said second input signal to compensate said rate to correct for intrinsic variations in corona discharge level, thereby producing more constant effective charge accumulation.

18. Apparatus of claim 16 wherein said translator means produce movement of the said source means uniformly adjacent with the working surface of a relatively stationary said medium means.

19. Apparatus of claim 16 wherein said translator means produces movement of the working surface of the said medium means uniformly adjacent a relatively stationary said source means.

20. Apparatus of claim 16 wherein said first signal input means comprises probe means effective to receive a sample of said corona discharge.

21. Apparatus of claim 20 wherein said probe means is provided as an ancillary electrode means adjacent with said source means, effective for receiving a representative portion of the total corona discharge current flow.

22. Apparatus of claim 16 wherein said first signal input means comprises a current sensor means coupled between the medium means and the electric return path to the source means, whereby said sensor means produces a signal proportional to said corona discharge level.

23. Apparatus of claim 22 wherein said sensor means comprises a resistor in the range of 100 ohms to 100,000 ohms, wherein further the produced said signal is in the range of 100 millivolts to 100 volts, representing a corona discharge current in the range of 50 microamperes to 10 milliamperes.

24. Apparatus of claim 16 wherein said second signal input means is preset to a predetermined value that correlates with the integrated charge current and charge time relationship which effects a finite accumulated charge ih the medium.

25. Apparatus of claim 16 wherein said translator means rate of relative movement increases relative with an increase in corona discharge current and a constant preset second input signal level.

26. Apparatus of claim 16 wherein said translator means rate of relative movement decreases relative with an increase in the presettable desired value of charge accumulation and a constant first input signal level.

27. Apparatus of claim 19 wherein said medium means comprises an endless loop, e.g. a belt, of electrochargeable material.

28. Apparatus of claim 19 wherein said medium means comprises an electrochargeable material supported on the surface of a planar substrate medium.

29. Apparatus of claim 16 wherein said electrochargeable medium means comprises a light sensitive electrophotographic means.

30. Apparatus of claim 16 wherein said source means comprises a thin elongated wire member suspended adjacently parallel with the effectively planar surface of the said medium means.

31. Apparatus of claim 21 wherein said ancillary electrode means comprises a planar conductive surface parallel with said source means field and oriented to substantially produce minimum interference with the electric corona field produced between the source means and the medium means.

32. Apparatus of claim 16 wherein said source means is essentially powered by an electric constant current power supply means.

33. Apparatus of claim 16 wherein said control means includes overdrive means effective to override said first signal input and said second signal input and provide a fixed rate of said relative movement.

34. Apparatus of claim 16 wherein said control means said second signal input derives from a computer DATA BUS signal comprising a digital WORD including several BITS, thereby serving to interface the instant apparatus with a binary logic based control system.

35. Apparatus of claim 34 wherein said digital WORD is effectively derived from a binary memory means.

36. Apparatus of claim 16 wherein said control means includes clamp means responsive with said first input signal to inhibit false said translator movement when no normal said corona discharge occurs.

37. Apparatus of claim 36 wherein said control means includes overdrive means effective to override said clamp means.

* * * * *